US005355625A

United States Patent [19]

Matsuoka

[11] Patent Number: 5,355,625

[45] Date of Patent: Oct. 18, 1994

[54] WOOD-CASED GLASS DOOR ASSEMBLY

[75] Inventor: Hisayuki Matsuoka, Tokyo, Japan

[73] Assignee: Kabushiki Kaisha Tomoku, Tokyo, Japan

[21] Appl. No.: 999,717

[22] Filed: Dec. 31, 1992

[51] Int. Cl.[5] ..... E05D 7/00

[52] U.S. Cl. ..... 49/400; 49/381; 49/475.1; 52/232; 52/788

[58] Field of Search ..... 49/381, 400, 401, 380, 49/475.1, 504; 52/232, 788, 789, 790

[56] References Cited

U.S. PATENT DOCUMENTS

| | | | |
|---|---|---|---|
| 2,910,739 | 11/1959 | Snitker | 49/504 |
| 3,426,491 | 2/1969 | Gaeth et al. | 49/504 X |
| 3,566,541 | 3/1971 | Coulter | 49/475.1 |
| 4,045,930 | 9/1977 | Dixon | 49/475.1 X |
| 4,144,688 | 3/1979 | Dixon | 49/475.1 X |
| 4,246,304 | 1/1981 | Dixon | 49/475.1 X |
| 4,424,653 | 1/1984 | Heinen | 52/232 X |
| 4,930,276 | 6/1990 | Bawa et al. | 52/232 X |

FOREIGN PATENT DOCUMENTS 455211 10/1956 Sweden .

OTHER PUBLICATIONS

Fönsterboken, Etri Fönster AB 1978, three pages.

*Primary Examiner*—Philip C. Kannan

[57] ABSTRACT

Disclosed herein is a wood-cased glass door assembly in which a glass door that may be opened is composed of a glazing, and wooden stiles and rails, which are fitted on an outer peripheral edge of the glazing. The wood-cased glass door is mounted for opening and closing into a wooden doorcase fixed in an opening in a wall. Thermally expanding materials are separately installed in spaces defined between an inner peripheral portion of the wooden doorcase and outer peripheral portions of the wooden stiles and rails and between inner peripheral portions of the wooden stiles and rails and the outer peripheral edge of the glazing over the entire length in the longitudinal directions of the spaces. The expanding materials foam and expand under heat to block the respective spaces. Metal fittings for holding the glazing by putting the inner and outer surfaces of the outer peripheral edge of the glazing therebetween are fixed to the wooden stiles and rails.

10 Claims, 4 Drawing Sheets

WOOD-CASED GLASS DOOR ASSEMBLY

FIELD OF THE INVENTION

The present invention relates to a wood-cased glass door assembly having a glass door that may be opened.

BACKGROUND OF THE INVENTION

In general, wood-cased glass door assemblies having a glass door that may be opened have a structure wherein a glass door includes a glazing, and wooden stiles and rails, which are fitted on an outer peripheral edge of the glazing. The glass door may be opened and closed and is fitted into a wooden doorcase fixed in an opening in a wall. The wood-cased glass door provides a feel characteristic of wood, with a soft appearance and graceful texture unlike aluminum sashes and the like. Moreover, a wood-cased glass door is easy to process and excellent in design. Therefore, such doors are used in many buildings.

In the wood-cased glass door assemblies of this kind, spaces are required between the wooden doorcase and the stiles and rails of the glass door for their opening and closing operation. It is also unavoidable that spaces are defined between the stiles and rails, and glazing of the glass door from the viewpoint of production and processing. In addition, spaces having relatively large widths are defined between the wooden doorcase and the wooden bottom rail of the glass door and between the wooden bottom rail and the glazing, in particular, at the bottom of the wood-cased glass door assembly from the viewpoint of necessity of draining.

For this reason, the wood-cased glass door assemblies of this kind involve a disadvantage that when a fire occurs on the inside or outside of a wood-cased glass door assembly, flames and smoke tend to exit or enter together with hot air through the above-described spaces even at the initial stage of the fire.

Further, since the flames tend to enter the spaces as described above, the wooden parts also tend to be damaged by the fire at a comparatively early stage. The damage of the wooden parts by the fire involves a disadvantage in that the glazing falls off from the stiles and rails, so that the interior and exterior thereof communicate with each other and the flames and smoke hence freely exit or enter therethrough, resulting in the spread of the fire.

OBJECTS AND SUMMARY OF THE INVENTION

In order to solve such disadvantages, it is an object of the present invention to provide a wood-cased glass door assembly, which can prevent flames and smoke from exiting or entering through spaces of the wood-cased glass door assembly upon occurrence of a fire and inhibit a glazing from falling off due to the damage of wooden parts by the fire as far as possible. The wood-cased glass door is excellent in fire resistant properties.

In order to achieve such an object, according to the present invention, there is thus provided a wood-cased glass door assembly in which a glass door that may be opened is composed of a glazing, and wooden stiles and rails, which are fitted on an outer peripheral edge of the glazing. The wood-cased glass door is opened and closed to fit into a wooden doorcase fixed in an opening in a wall, wherein thermally expanding materials are separately installed in spaces defined between an inner peripheral part of the wooden doorcase and outer peripheral parts of the wooden stiles and rails and between inner peripheral parts of the wooden stiles and rails and the outer peripheral edge of the glazing over the entire length in the longitudinal directions of the spaces. The expanding materials foam and expand under heat to block the respective spaces. Metal fittings are provided for holding the glazing by putting the inner and outer surfaces of the outer peripheral edge of the glazing therebetween which are fixed to the wooden stiles and rails.

According to such an aspect of this invention, when a fire occurs on the inside or outside of the wood-cased glass door assembly, the thermally expanding materials momentarily foam and expand under the heat generated by the fire, thereby blocking the spaces defined between the inner peripheral part of the wooden doorcase and the outer peripheral parts of the wooden stiles and rails and between the inner peripheral parts of the wooden stiles and rails and the outer peripheral edge of the glazing. This blocking can prevent flames and smoke from exiting or entering through the spaces. In addition, the blocking of the spaces can inhibit the circulation of air in the spaces and at the same time, delay the damage of the wooden doorcase and the wooden stiles and rails by the fire because entry of the flames into the spaces is prevented.

Although the wooden stiles and rails are burned into carbonized layers and finally ashed with the spread of the flames, the falling off of the glazing is prevented because the glazing is held between the metal fittings fixed to the wooden stiles and rails so long as they substantially keep their original shape.

Therefore, according to the present invention, the combination of the blocking of the spaces with the prevention of the falling off of the glazing can prevent the flames, smoke and hot air from blowing through the wood-cased glass door assembly and hence surely prevent the fire from spreading.

In some cases, spaces for drainage may be defined between the wooden doorcase and the wooden rail and between the wooden rail and the glazing at the bottom of the wood-cased glass door assembly. These drain space parts respectively have inclined drain surfaces, which have been descendingly formed on the inner peripheral surface at the bottom of the wooden doorcase and the inner peripheral surface of the wooden bottom rail, and open so as to become wider toward the outside. In the case where such drain space parts are provided, it is preferred that the thermally expanding material should provide bordering on each drain space part because flames and the like are easy to enter such drain space parts than the other spaces upon the occurrence of a fire. This provision permits the rapid blocking of the drain space parts, into which the flames and the like are easy to enter, with the thermally expanded materials upon the occurrence of the fire and hence the momentary prevention of the entry of the flames and the like into the drain space parts.

Further, in the case where the thermally expanding materials are provided in the drain space parts situated at the bottom of the wood-cased glass door assembly as described above, it is preferred that with respect to the drain space part defined between the wooden doorcase and the wooden rail, the thermally expanding material should be fixed to the wooden rail positioned over the drain space part, and that with respect to the drain space part defined between the wooden rail and the glazing, the thermally expanding material should be fixed to the glazing positioned over the drain space part. Therefore, it is possible to prevent waterdrops and the like, which are easy to collect in the drain space parts, from adhering to the thermally expanding materials and hence can avoid their deterioration. If the thermally expanding material is fixed to the wooden rail under the drain space part, water penetrates the thermally expanding material and hence, the deterioration of the wooden rail also tends to occur. However, such a disadvantage can also be solved by fixing the thermally expanding material to the glazing.

It is preferred that the thermally expanding material installed in each of the spaces defined between the inner peripheral parts of the wooden stiles and rails and the outer peripheral edge of the glazing should be divided so as to be provided with an interval at positions near the inner and outer surfaces of the openable glass door. Such provision permits either the rapid foaming and expansion of the thermally expanding material situated near the outer surface of the openable glass door upon occurrence of a fire on the outside of the wood-cased glass door assembly to block the space or the rapid foaming and expansion of the thermally expanding material situated near the inner surface of the openable glass door upon occurrence of a fire on the inside of the wood-cased glass door assembly to block the space, whereby even when a fire occurs on either side of the wood-cased glass door assembly, the blocking of the space can be rapidly achieved.

The glazing preferably comprises at least one wire glass plate or heat-resistant tempered glass plate. By the use of the wire glass plate or heat-resistant tempered glass plate in a glazing as described above, the wire glass plate substantially keeps its original shape even when the glass material is melted by flames because the glass material remains adhered to a wire net embedded therein, while the heat-resistant tempered glass plate also keeps its original shape. Therefore, the falling off of the glazing is prevented in cooperation with the holding of the glazing by the metal fittings.

In this case, when the glazing is composed of plural glass plates including the wire glass plate or heat-resistant tempered glass plate, which are superposed through a space layer between adjacent glass plates, a sealer for shielding the space layer against the open air is generally fixed to the outer peripheral edge of the glazing. This sealer is made of a combustible material. In this case, it is preferred that the thermally expanding material installed in each of the spaces defined between the inner peripheral parts of the wooden stiles and rails and the outer peripheral edge of the glazing should be fixed to the wire glass plate or heat-resistant tempered glass plate. This ensures that the thermally expanding material installed in each of the spaces defined between the inner peripheral parts of the wooden stiles and rails and the outer peripheral edge of the glazing remains fixed to the wire glass plate or heat-resistant tempered glass plate, which keeps its original shape even when a fire advances, thereby blocking the spaces. It is therefore possible to prevent the flames from spreading through the wood-cased glass door assembly via the combustible sealer.

The metal fittings are preferably fixed to the wooden stiles and rails by slender fasteners such as nails or screws. This ensures that even if the wooden stiles and rails are burned by the flames, the falling off of the glazing is prevented because the metal fittings are held by the slender fasteners which have been inserted in the interior of the wooden stiles and rails so long as the wooden stiles and rails keep their solid shape.

In this case, it is preferred that the slender fasteners should be inserted in the wooden stiles and rails toward their core side from their surface side. When a fire occurs, the wooden stiles and rails are gradually burned by flames toward their core sides from their surface sides. More specifically, the surfaces of the wooden stiles or rails, which have been carbonized at the initial stage of the fire, serve as heat insulating layers, so that it becomes difficult for the burning to advance to the core of the wooden stiles and rails. The carbonizing rate is reduced as the burning progresses toward the cores of the wooden stiles and rails. For this reason, when the slender fasteners are inserted as described above, the metal fittings are held for a longer time by the wooden stiles and rails because it takes a long time for the burning of the wooden stiles and rails to reach portions at which the tips of the slender fasteners have been inserted. Therefore, such insertion has an effect on the prevention of the falling off of the glazing.

Other objects and advantages of the present invention will be readily appreciated from the preferred embodiments of this invention, which will be described subsequently in detail with reference to the accompanying drawings.

DETAILED DESCRIPTION OF THE PREFERRED EMBODIMENTS

Figure 1:
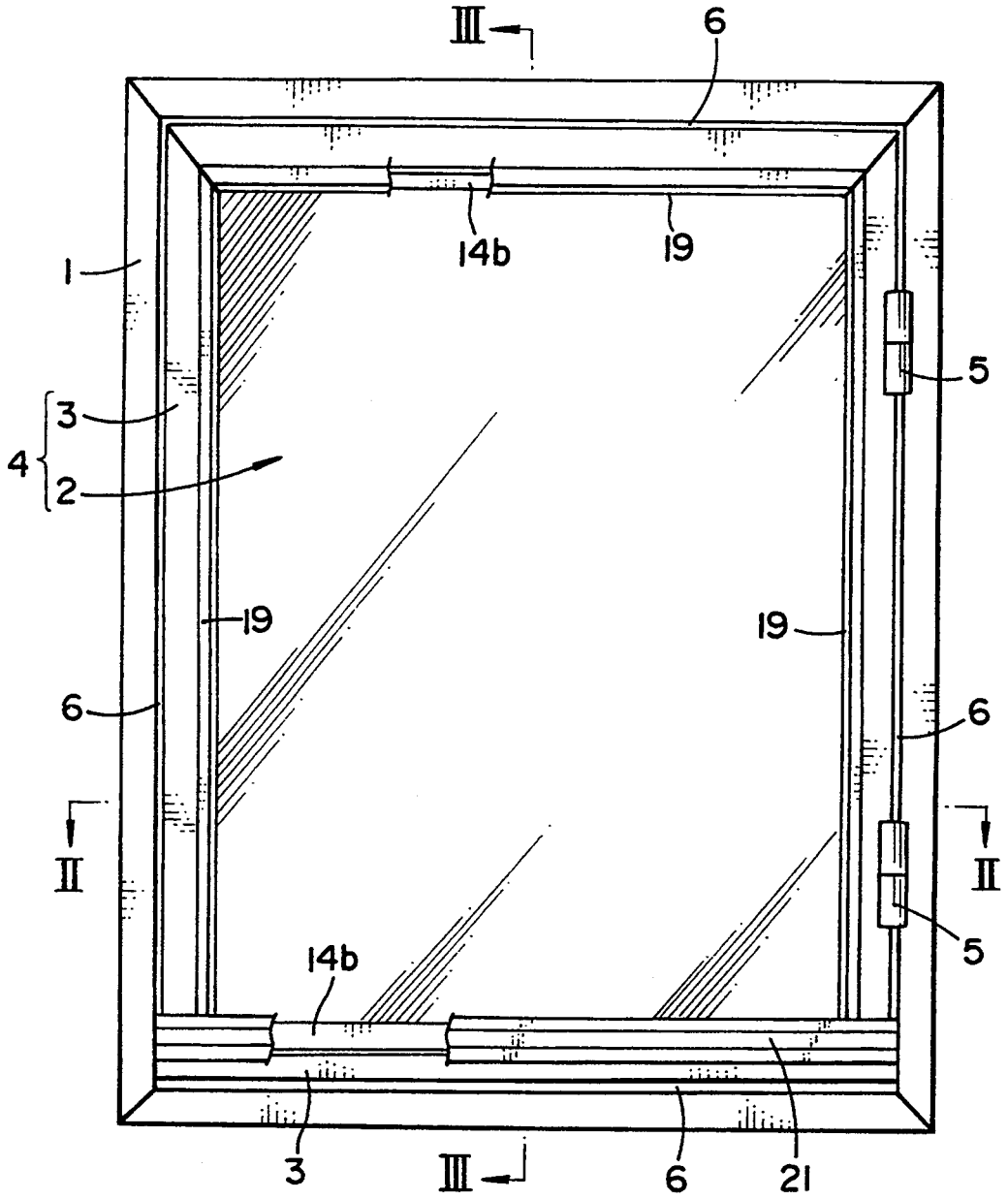
FIG. 1 is a front view of a wood-cased glass door assembly according to an embodiment of the present invention, viewed from the outdoors.
Figure 2:
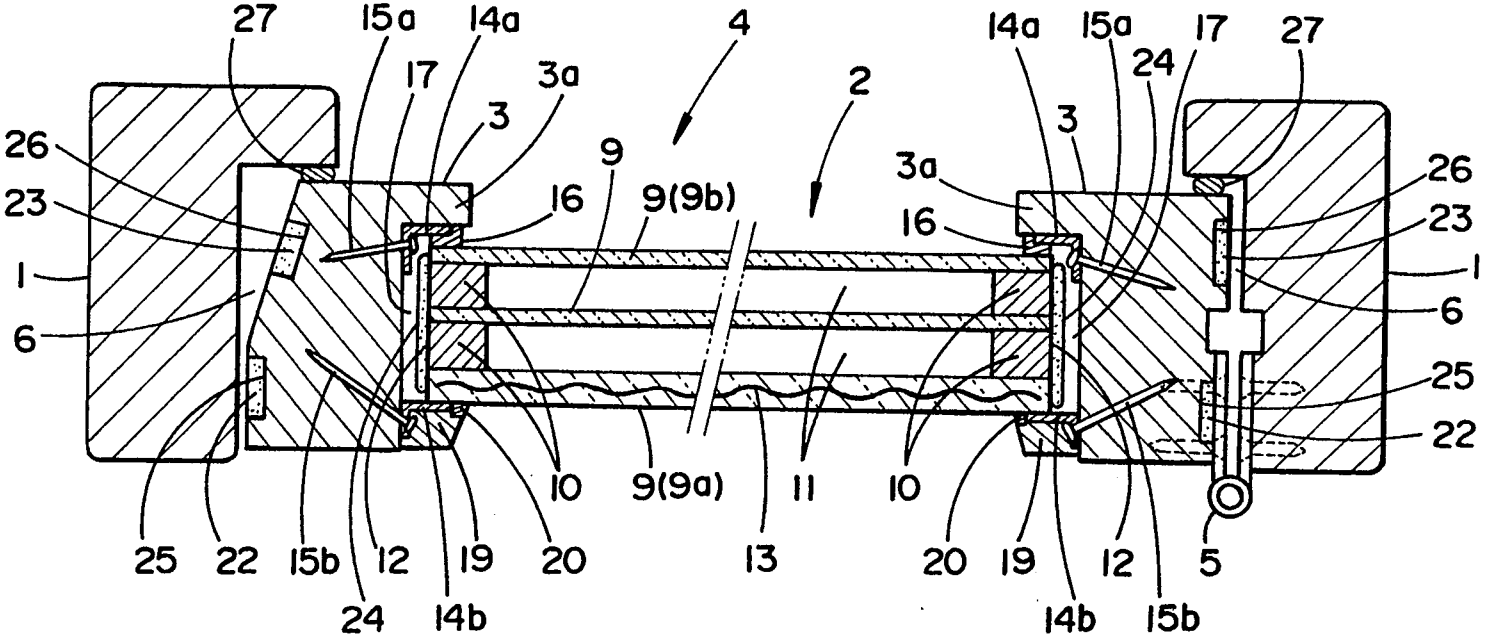
FIG. 2 is a cross-sectional view taken along line II-II of FIG. 1.
Figure 3:
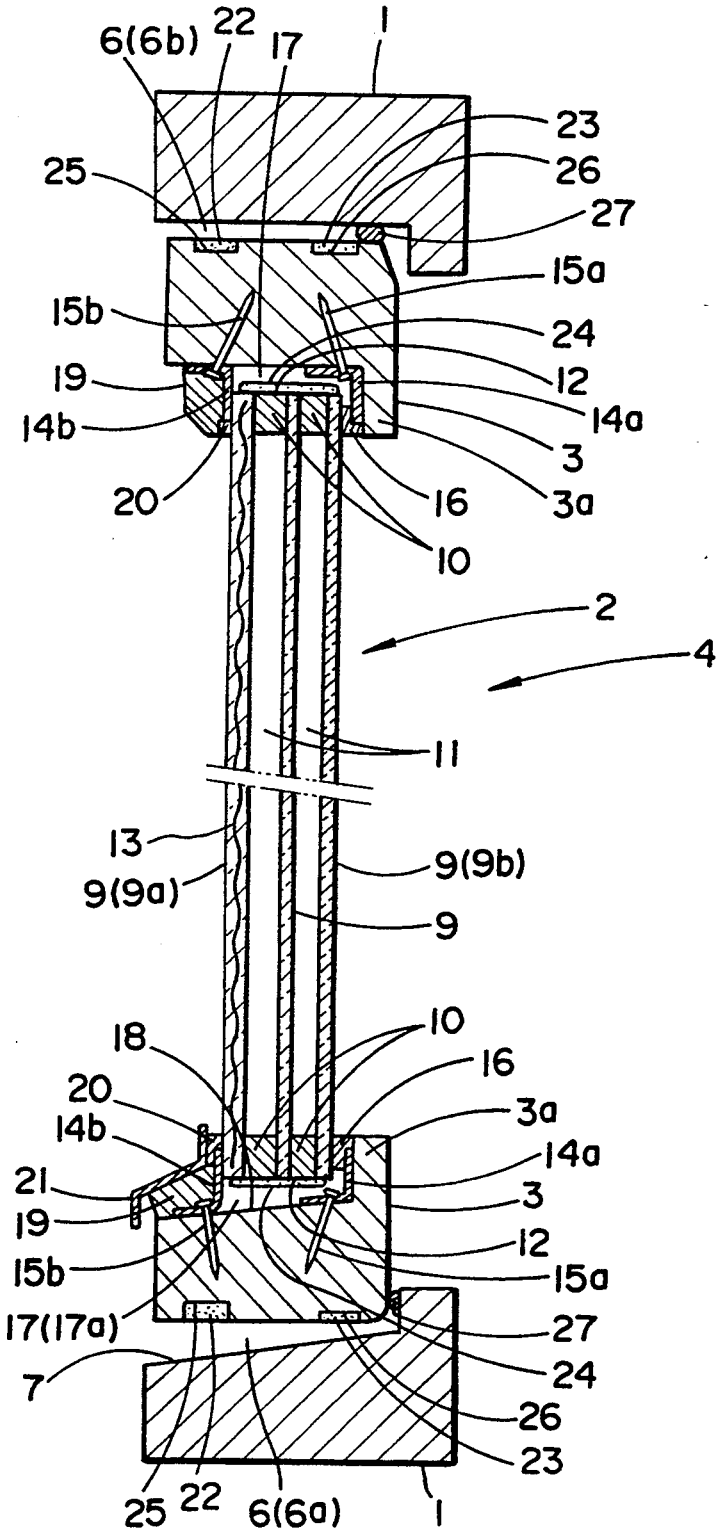
FIG. 3 isa cross-sectional view taken along line III-III of FIG. 1.

A wood-cased glass door assembly according to an embodiment of the present invention will hereinafter be described by reference to FIGS. 1 through 3. FIG. 1 is a front view of the wood-cased glass door assembly according to an embodiment of the present invention, partly broken away and viewed from the outer side, FIG. 2 is a cross-sectional view taken along line II—II of FIG. 1 and FIG. 3 is a cross-sectional view taken along line III—III of FIG. 1.

Referring now to FIG. 1, the wood-cased glass door assembly comprises a wooden doorcase 1 in the form of a rectangular frame, which is fixed in an opening in a wall of a building not illustrated, and an openable glass door 4 composed of a glazing 2, and wooden stiles and rails, which are formed into a rectangular frame 3 and fitted on an outer peripheral edge of the glazing 2, said glass door 4 being openably and closably fitted into the wooden doorcase 1.

In this case, according to this embodiment, the frame 3 of the glass door 4 is attached to the doorcase 1 at one side edge thereof by hinges 5, whereby the glass door 4 is swingably movable about the hinges 5.

Incidentally, the means to open and close the glass door 4 is not limited to the swing system as described above, and may be a means to vertically move the glass door 4 or the like.

A space 6 is defined between the outer peripheral part of the frame 3 of the glass door 4 and the inner peripheral part of the doorcase 1 over substantially the entire length thereof so as to be able to smoothly open and close the glass door 4.

In this case, the wood-cased glass door assembly of this embodiment is attached to a building in such a manner that in FIG. 3, the left side of the assembly is directed to the out side, and the right side is opposite to the interior of the building. An inclined drain surface 7 is formed descendingly toward the outside on the inner peripheral part at the bottom of the doorcase 1. A portion of the space 6, which is defined between the inclined drain surface 7 and the frame 3, is a drain space part 6*a* opened so as to become wider toward the outside by the inclined drain surface 7. Therefore, waterdrops and the like, which have entered the space 6, fall by their own weight to the drain space part 6*a* along the inner peripheral part of the doorcase 1 and the outer peripheral part of the frame 3, and are discharged from the drain space part 6*a* to the outdoors along the inclined drain surface 7.

In the wood-cased glass door assembly according to this embodiment, as shown in FIGS. 2 and 3, the glazing 2 of the glass door 4 is composed of a plurality of glass plates.

Namely, the glazing 2 is composed of a plurality (three in this embodiment) of glass plates 9 and is formed into a multi-layer construction by superposing these glass plates 9 interposing a spacer 10 between adjacent glass plates and bonding the portions interposed with the spacers 10 by an adhesive (not illustrated) such as butyl rubber. Space layers 11 are defined between the adjacent glass plates 9 except for the portions interposed with the spacers 10.

In this case, though not illustrated in detail, each of the spacers 10 is made of a metal by its outer peripheral part and hermetically contains a desiccating agent (not illustrated) for removing the moisture within the space layer 11 from its interior. Besides, a sealer 12 for shielding the space layer 11 against the open air is applied onto the outer peripheral surface of the glazing 2 composed of the glass plates 9 superposed over each other as described above. The sealer 12 is composed of, for example, a silicone sealing material and is combustible. Further, in this embodiment, the outermost glass plate 9*a* of the glass plates 9 is a wire glass plate 9*a* with a wire net 13 embedded therein.

Such a glazing 2 is assembled in the frame 3 in the following manner.

Namely, referring to FIGS. 2 and 3, the frame 6 includes a flange 3*a* projecting on the side of its inner peripheral part and formed at an end surface of the frame 3 on the indoor side over the entire periphery thereof, and a metal fitting 14*a* in an L-shape in section, which has been fixed by nails 15*a* as slender fasteners over the entire periphery to the inner peripheral part of the frame 3, which ranges to the inner wall of the flange 3*a*. Upon assembly of the glazing 2, it is first of all inserted in an opening defined within the frame 3 from the outdoor side until the peripheral edge of the innermost glass plate 9*b* is brought into contact with the inner wall of the flange 3*a* through a sealer 16.

At this time, a space 17 is defined between the inner peripheral part of the frame 3 and the outer peripheral part of the glazing 2 due to accuracy in production and processing of the frame 3 and glazing 2, and the like. In particular, as illustrated in FIG. 3, an inclined drain surface 18 is formed descendingly toward the out side on the inner peripheral part at the bottom of the frame 3. Therefore, a drain space part 17*a* opened so as to become wider toward the out side is defined between the inclined drain surface 18 and the bottom surface of the glazing 2.

In the state where the glazing 2 has been brought into contact with the flange 3*a* of the frame 3 through the sealer 16 as described above, a metal fitting 14*b* in an L-shape in section is further fixed by nails 15*b* as slender fasteners to the inner peripheral part of the frame 3 so as to hold the peripheral edge of the glazing 2 in cooperation with the metal fitting 14*a*. This metal fitting 14*b* is paired with the metal fitting 14*a* so as to prevent the glazing 2 from falling off upon occurrence of a fire as described below. In this case, the nails 15*a* fixing the metal fitting 14*a* to the frame 3 are driven into the interior of the frame 3 so as to obliquely extend from the indoor side to the outdoor side, while the nails 15*b* fixing the metal fitting 14*b* to the frame 3 are driven into the interior of the frame 3 so as to obliquely extend from the outdoor side to the indoor side.

In this embodiment, nails 15*a*, 15*b* have been used as the slender fasteners in this embodiment. However, screws or the like may be used.

A wooden holding member 19 in the form of an archival frame is fitted into the opening defined within the frame 3 from the outdoor side toward the glazing 2. This wooden holding member 19 is brought into contact with the peripheral edge of the wire glass plate 9*a* of the glazing 2 through a sealer 20 so as to cover the metal fitting 14*b*, and is fixed to the inner peripheral part of the frame 3 by an adhesive or nails (not illustrated). Therefore, the glazing 2 is held between the wooden holding member 19 and the flange 3*a* of the frame 3 in the state where it has been put between the metal fittings 14*a*, 14*b*.

As illustrated in FIG. 3, a drain plate 21 is fixed to the wooden holding member 19 at its bottom so as to project toward the out side.

As described above, thermally expanding materials 22, 23 are installed in the space defined between the inner peripheral part of the doorcase 1 and the outer peripheral part of the frame 3 over the entire length thereof, and a thermally expanding material 24 is also installed in the space 17 defined between the outer peripheral part of the glazing 2 and the inner peripheral part of the frame 3 over the entire length thereof.

Namely, as illustrated in FIGS. 2 and 3, a set of recesses 25, 26 are formed with a predetermined interval at positions near the out side and the interior of the building of the outer peripheral part of the frame 3, which borders on the space 6, and the thermally expanding materials 22, 23 are embedded in and fixed to these recesses 25, 26, respectively. In this case, the thermally expanding material 22 provided at the position near the outdoors is embedded in the recess 25 at a position bordering on the drain space part 6*a* as illustrated in FIG. 3. In particular, the thickness of the thermally expanding material 22 bordering on the drain space part 6*a* having a wider opening is made thicker than that of the thermally expanding materials at the other position.

On the other hand, the thermally expanding material 24 installed in the space 17 defined between the glazing 2 and the frame 3 is fixed to the outer peripheral part of the glazing 2 including the outer peripheral part of the wire glass plate 9*a*. In this case, the thickness of the thermally expanding material 24 bordering on the comparatively large drain space part 17*a* is also made comparatively thick.

These thermally expanding materials 22, 23 and 24 are caused to foam and expand under heat generated upon occurrence of a fire. Such foaming and expansion permit the blocking of the spaces 6 and 17.

In this case, the thermally expanding materials 22–24 include mainly ceramic and carbon types. Those of the ceramic type tend to be deteriorated by carbon dioxide in the air and the like compared with those of the carbon type. It is hence preferable to use those of the carbon type (for example, "Intumex", trade mark, product of CHEMIE LINZ AG, Austria).

In FIGS. 2 and 3, a packing material 27 is interposed between the doorcase 1 and the frame 3.

The fire-protecting action of the wood-cased glass door assembly according to this embodiment will hereinafter be described.

In the case where a fire occurs, for example, on the out side, flames and smoke first of all attempt to come in together with hot air on the in side of the door through the space 6 between the doorcase 1 and the frame 3. The frame 3 which is made of wood, and the holding member 19 and sealers 16, 20 then begin to burn, so that flames, smoke and hot air attempt to enter on the in side through the space 17 between the frame 3 and glazing 2. Similarly, even in the case where a fire occurs on the in side, flames, smoke and hot air attempt to come out to the out side through the spaces 6, 17.

At this time, with respect to the space 6, the thermally expanding material 22 or 23 positioned on the side where the fire occurs is caused to rapidly foam and expand under heat, thereby blocking the space 6. When the fire further spreads, the other thermally expanding material 23 or 22 is also caused to foam and expand, thereby blocking the space 6. Therefore, it is avoidable for the flames and the like to enter the space 6 to propagate from the space 6 to the interior or exterior of the building, and moreover for the air to circulate in the space 6. Accordingly, it is possible to delay the burning of the doorcase 1 and the frame 3, which border on the space 6.

In this embodiment, the thermally expanding materials 22, 23 are provided at the positions near the out side and the interior of the building, respectively. Therefore, if a fire occurs either inside or outside the building, either thermally expanding material 22, 23 positioned on the side where the fire occurs is caused to rapidly foam and expand, whereby the space 6 can be rapidly blocked at the initial stage of the fire.

The flames tend to enter the drain space parts 6*a*, 6*b* having a wider opening of the space 6. However, since the thermally expanding material 22 is provided on the border of the drain space parts 6*a*, 6*b*, the drain spaces 6*a*, 6*b* can be rapidly blocked at the initial stage of the fire, thereby preventing the flames and the like from entering the drain space parts 6*a*, 6*b*.

With respect to the space 17, the thermally expanding material 24 bordering on the space 17 is caused to rapidly foam and expand under heat like the thermally expanding materials 22, 23, thereby blocking the space 17. Therefore, it is avoidable for the flames and the like to enter the space 17 to propagate from the space 17 to the interior or exterior of the building, and moreover for the air to circulate in the space 17. Accordingly, it is possible to delay the burning of the frame 3 bordering on the space 17.

In this case, the flames tend to enter the drain space part 17*a* having a wider opening of the space 17. However, since the thermally expanding material 24 is provided on the border of the drain space 17*a*, the drain space part 17*a* can be rapidly blocked at the initial stage of the fire, thereby preventing the flames and the like from entering the drain space part 17*a*.

On the other hand, as the fire progresses, the frame 3 made of wood is burned in due course of time, so that the glazing 2 becomes liable to fall off.

According to the wood-cased glass door assembly of this invention, however, the glazing 2 is held by the metal fittings 14*a*, 14*b*, which have been fixed to the frame 3 by the nails 15*a*, 15*b*, respectively, in such a manner that the peripheral edge of the glazing 2 is placed between the metal fittings 14*a*, 14*b* as described above. Therefore, the glazing 2 is held between the metal fittings 14*a*, 14*b* so long as the frame 3 substantially maintains its original shape even if the frame 3 is carbonized, whereby the falling off of the glazing 2 is prevented.

In this embodiment, since the metal fittings 14*a*, 14*b* is fixed to the frame 3 by the nails 15*a*, 15*b* as slender fasteners, which have been driven into the frame 3, they are fixed to and held by the frame 3 until the frame 3 come near to a ashed stage, whereby the falling off of the glazing 2 can be prevented over a comparatively long period of time.

When the frame 3 is burned by the fire, the burning generally begins at a portion of the frame 3 where the air is easy to contact, such as portions directly bordering on the out side or the interior of a building, and parts bordering on the space 6. However, as described above, the nails 15*a* fixing the metal fitting 14*a* to the frame 3 are driven into the interior of the frame 3 so as to obliquely extend from the in side to the out side, while the nails 15*b* fixing the metal fitting 14*b* to the frame 3 are driven into the interior of the frame 3 so as to obliquely extend from the out side to the in side, in other words, the nails 15*a*, 15*b* are driven into the frame 3 so as not to come near to parts of the frame 3, which are easy to burn. Thus, the situation where the metal fittings 14*a*, 14*b* fall off from the frame 3 can be delayed as far as possible. Therefore, the falling off of the glazing 2 can be delayed as far as possible.

In this embodiment, the glazing 2 includes the wire glass plate 9*a*. Therefore, if the glass material of the wire glass plate 9*a* is melted by the flames, the glass material remains adhered to a wire net embedded therein, so that the wire glass plate 9*a* remains held between the metal fittings 14*a*, 14*b*. Therefore, it is possible to prevent the flames and the like from coming out or in through a molten portion of the glazing 2.

Although the sealer 12 coated on the outer peripheral part of the glazing 2 is combustible, the space 17 is held in a state that it has been surely blocked, and the entry of the flames into the space 17 is continuously prevented because the wire glass plate 9*a* substantially keeps its original shape and at the same time, the thermally expanding material 24 blocking the space 17 between the glazing 2 and the frame 3 is fixed to the outer peripheral part of the glazing 2 including the outer peripheral part of the wire glass plate 9*a*. A situation where the sealer 12 directly catches fire and the flames spread to the interior or exterior of the building through the sealer 12 is thus avoided.

According to the wood-cased glass door assembly of this embodiment, as described above, the thermally expanding materials 22–24 can rapidly prevent flames and the like from entering the spaces 6, 17 upon occurrence of a fire and moreover, the metal fittings 14*a*, 14*b* can prevent the glazing 2 from falling off over a long period of time as far as possible, thereby effectively avoiding the spread of the fire to the interior or exterior of a building. There can be thus provided a wood-cased glass door assembly which has excellent fire resistant properties.

The wood-cased glass door assembly according to this embodiment was tested in accordance with the second-grade fire-resistant performance test prescribed by Notification No. 1125 of the Ministry of Construction of Japan in the second year of Heisei. This test will be outlined. Namely, after the wood-cased glass door assembly is heated by flames from one side thereof for a predetermined period of time, a 3 kg sandbag is lifted with a swing from the lowest position to a height of 50 cm and then caused to fall with a swinging movement at the center of a glass surface opposite to the heated glass surface of the wood-cased glass door assembly. In this test, neither the falling off of the glazing 2 from the wood-cased glass door assembly according to this embodiment nor the formation of a hole was observed even by the collision of the sandbag.

Figure 4:
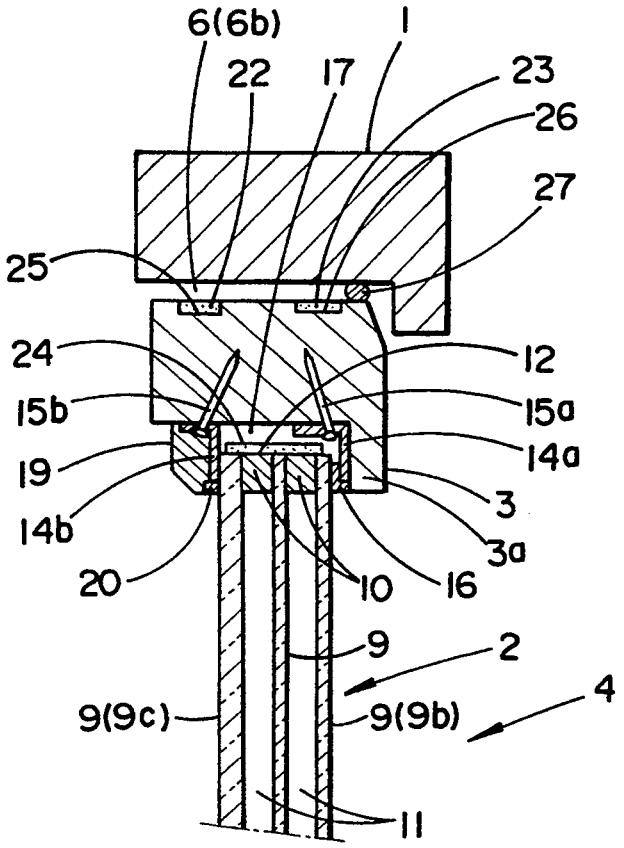
FIG. 4 is a longitudinal sectional view of an upper part of a wood-cased glass door assembly according to another embodiment of the present invention.

A wood-cased glass door assembly according to another embodiment of the present invention will hereinafter be described by reference to FIG. 4. FIG. 4 is a longitudinal sectional view of an upper part of the wood-cased glass door assembly according to another embodiment of the present invention. Incidentally, in FIG. 4, like reference characters are given to the same components as those in the wood-cased glass door assembly illustrated in FIG. 1 upon description, and their detailed description is omitted.

In FIG. 4, the wood-cased glass door assembly of this embodiment is constructed in such a manner that a heat-resistant tempered glass plate 9*c* is used as the outermost glass plate of the glass plates 9 constituting a glazing 2 in place of the wire glass plate 9*a* used in the above-described embodiment, and a thermally expanding material 24 is fixed to the outer peripheral part of the glazing 2 including the outer peripheral part of the tempered glass plate 9*c*. Other features are identical with those in the above-described embodiment. Incidentally, examples of the heat-resistant tempered glass plate 9*c*, may be "PYRAN" (trade mark, product of TechTransfer Scandinavia AB and "Firelight" (trade name, product of Nippon Electric Glass Co., Ltd.).

As with the case making use of a wire glass plate 9*a*, such a construction in cooperation with the metal fittings 14*a*, 14*b* prevents the heat-resistant tempered glass plate 9*c* from falling off and the inside and outside of the glazing 2 from communicating with each other because the heat-resistant tempered glass plate 9*c* substantially keeps its original shape without forming holes therein even when melted by flames. Further, the thermally expanding material 24 blocking the space 17 between the glazing 2 and the frame 3 continuously blocks the space 17 while being fixed to the heat-resistant tempered glass plate 9*c* which keeps its original shape. It is therefore possible to prevent the fire from spreading through the wood-cased glass door assembly.

In this embodiment as described above, the thermally expanding material 22, 23 installed in the space 6 have been embedded in the frame 3. It goes without saying that they may be simply stuck on the outer peripheral surface of the frame 3, or may be fixed to the inner peripheral parts of the doorcase 1.

However, the fixing of the thermally expanding materials to the frame 3 is advantageous in the following respects compared with their fixing to the doorcase 1.

Namely, waterdrops and the like are generally easy to collect in the drain space part 6*a* defined at the bottom of the wood-cased glass door assembly. Therefore, if the thermally expanding materials are fixed to the doorcase 1, which is located on the lower side of the drain space part 6*a*, in the drain space part 6*a*, the waterdrops and the like are easy to directly adhere to the thermally expanding materials, whereby the thermally expanding materials become liable to deteriorate. In addition, water penetrates the thermally expanding materials and hence, the doorcase to which the thermally expanding materials have been fixed also becomes liable to deteriorate. On the contrary, when the thermally expanding materials 22, 23 are fixed to the frame like in the present embodiment, they come to be located on the upper side of the drain space part 6*a* in the drain space part 6*a*, so that waterdrops and the like become difficult to adhere to the thermally expanding materials 22, 23. Therefore, with time the deterioration of the thermally expanding materials 22, 23 and the doorcase 1 can be prevented.

In the above-described embodiments, the thermally expanding material 24 installed in the space 17 has been fixed to the outer peripheral portion of the glazing 2. However, it goes without saying that it may be fixed to the inner peripheral portion of the frame 3, or may be embedded in the outer peripheral part of the glazing 2 or the inner peripheral part of the frame 3.

However, in this case, it is also preferred for the same reason as in the thermally expanding materials 22, 23 that the thermally expanding material 24 should be fixed to the glazing 2 located on the upper side of the drain space part 17*a* like these embodiments.

In these embodiments, the thermally expanding materials 22, 23 installed in the space 6 have been provided with an interval at positions near the interior of the building and the outdoors. However, a single thermally expanding material having a relatively large width may be fixed to the outer peripheral part of the frame 3 or the inner peripheral part of the doorcase 1.

However, since the thermally expanding materials are generally expensive, the divisional provision of the thermally expanding materials at the positions near the interior of the building and the outdoors is advantageous from the viewpoint of cost compared with the use of the single thermally expanding material, and permits the rapid blocking of the space 6 according to a position where a fire occurs.

It goes without saying that the thermally expanding material 24 installed in the space 17 may be divided to provide them at positions near the interior of the building and the outdoors like the case of the space 6.

What is claimed is:

1. A wood-cased glass door assembly comprising:

an openable glass door composed of a glazing, and wooden stiles and rails, which are fitted on an outer peripheral edge of the glazing;

a wooden doorcase fixed in an opening in a wall, said door being mounted for opening and closing within said doorcase;

thermally expanding materials separately installed in spaces defined between an inner peripheral portion of the wooden doorcase and outer peripheral portions of the wooden stiles and rails and between inner peripheral portion of the wooden stiles and rails and the outer peripheral edge of the glazing over the entire length in the longitudinal directions of the spaces, said expanding materials foaming and expanding under heat to block the respective spaces; and metal fittings for holding the glazing, said metal fittings being positioned on inner and outer surfaces of the outer peripheral edge of the glazing therebetween are fixed to the wooden stiles and rails, wherein the thermally expanding material installed in the space between the inner peripheral portion of the wooden door case and the outer peripheral portions of the wooden stiles and rails is divided into two strips provided with an interval therebetween, one of said strips being disposed at a position near an inner surface of the openable glass door and another of said strips being disposed at a position near an outer surface of said openable glass door, wherein the space defined between the inner peripheral portion of the wooden doorcase and the outer peripheral portions of the wooden stiles and rails includes a drain space defined between an inclined drain surface and a lower one of said wooden rails, said drain surface being inclined downwardly on an inner peripheral surface at a bottom of said wooden doorcase, a portion of said two strips of thermally expanding material being installed in the space between said lower wooden rail and said drain surface, and wherein the strip of thermally expanding material disposed at the position near the outer surface of said operable glass door is thicker than the strip of thermally expanding material disposed at the position near the inner surface of said openable glass door.

2. The wood-cased glass door assembly as claimed in claim 1, wherein the space defined between the inner peripheral portion of the wooden doorcase and the outer peripheral portions of the wooden stiles and rails has at least a drain space part defined between an inclined drain surface, which has been descendingly formed on the inner peripheral surface at the bottom of the wooden doorcase, and the wooden rail, and the thermally expanding material installed in the space between the inner peripheral portion of the wooden doorcase and the outer peripheral portions of the wooden stiles and rails is provided bordering on the drain space part.

3. The wood-cased glass door assembly as claimed in claim 2, wherein the thermally expanding material installed in the space between the inner peripheral portion of the wooden doorcase and the outer peripheral portions of the wooden stiles and rails is fixed to the wooden stiles and rails.

4. The wood-cased glass door assembly as claimed in claim 1, wherein the thermally expanding material installed in the space between the inner peripheral portions of the wooden stiles and rails and the outer peripheral edge of the glazing is fixed to the glazing.

5. The wood-cased glass door assembly as claimed in claim 1, wherein the glazing comprises at least one wire glass plate.

6. The wood-cased glass door assembly as claimed in claim 5, wherein the glazing is composed of plural glass plates including the wire glass plate, which are superposed with a space layer between adjacent glass plates, a combustible sealer for shielding the space layer against the open air is fixed to the outer peripheral edge of the glazing, and the thermally expanding material installed in the space between the inner peripheral portions of the wooden stiles and rails and the outer peripheral edge of the glazing is fixed to the outer peripheral portion of the wire glass plate.

7. The wood-cased glass door assembly as claimed in claim 1, wherein the glazing comprises at least one heat-resistant tempered glass plate.

8. The wood-cased glass door assembly as claimed in claim 7, wherein the glazing is composed of plural glass plates including the heat-resistant tempered glass plate, which are superposed with a space layer between adjacent glass plates, a combustible sealer for shielding the space layer against the open air is fixed to the outer peripheral edge of the glazing, and the thermally expanding material installed in the space between the inner peripheral parts of the wooden stiles and rails and the outer peripheral edge of the glazing is fixed to the outer peripheral part of the heat-resistant tempered glass plate.

9. The wood-cased glass door assembly as claimed in claim 1, wherein the metal fittings are fixed to the wooden stiles and rails by slender fasteners such as nails.

10. The wood-cased glass door assembly as claimed in claim 9, wherein the slender fasteners are inserted in the wooden stiles and rails toward their core side from their surface side.

* * * * *